US010156238B2

(12) United States Patent
Nakagawa et al.

(10) Patent No.: US 10,156,238 B2
(45) Date of Patent: Dec. 18, 2018

(54) CENTRIFUGAL PUMP

(71) Applicant: Kabushiki Kaisha Saginomiya Seisakusho, Nakano-ku, Tokyo (JP)

(72) Inventors: Taiki Nakagawa, Sayama (JP); Seiichi Nakano, Sayama (JP)

(73) Assignee: KABUSHIKI KAISHA SAGINOMIYA SEISAKUSHO, Tokyo (JP)

( * ) Notice: Subject to any disclaimer, the term of this patent is extended or adjusted under 35 U.S.C. 154(b) by 345 days.

(21) Appl. No.: 14/995,443

(22) Filed: Jan. 14, 2016

(65) Prior Publication Data

US 2016/0208811 A1 Jul. 21, 2016

(30) Foreign Application Priority Data

Jan. 17, 2015 (JP) ..... 2015-007307

(51) Int. Cl.
*F04D 13/02* (2006.01)
*F04D 13/06* (2006.01)
(Continued)

(52) U.S. Cl.
CPC ..... *F04D 13/026* (2013.01); *F04D 13/0606* (2013.01); *F04D 13/0633* (2013.01);
(Continued)

(58) Field of Classification Search
CPC ..... F04D 13/026; F04D 13/0606; F04D 13/0633; F04D 29/048; F04D 29/4266; F04D 29/426
(Continued)

(56) References Cited

U.S. PATENT DOCUMENTS 4,304,532 A * 12/1981 McCoy ..... F16J 15/50 310/104
6,034,465 A * 3/2000 McKee ..... F04D 13/0666 310/156.23
(Continued)

FOREIGN PATENT DOCUMENTS

CN 103939357 A 7/2014
JP S49-47906 5/1974
(Continued)

*Primary Examiner* — Peter J Bertheaud
(74) *Attorney, Agent, or Firm* — Snyder, Clark, Lesch & Chung, LLP

(57) ABSTRACT

A centrifugal pump includes a rotating blade member including an impeller member and a rotor magnet, a main body casing accommodating the rotating blade member, a coil portion that rotates the rotating blade member is located on a periphery of the rotor magnet, and an axial member associated with the main body casing. The rotating blade member pivots around the axial member. The axial member includes an end portion at axial rotor magnet side, and is fixed at the end portion. The main body casing forms a fluid introducing passage, and is associated with a blade casing accommodating the rotating blade member. An end portion of a bearing portion at an axial fluid introducing passage side is protruded such that the end portion of the bearing portion protrudes from an inner periphery opening portion of the blade casing into the fluid introducing passage.

10 Claims, 12 Drawing Sheets

(51) Int. Cl.

| | |
|---|---|
| ***F04D 29/048*** | (2006.01) |
| ***F04D 29/42*** | (2006.01) |
| ***F04D 29/046*** | (2006.01) |
| ***F04D 29/22*** | (2006.01) |
| ***F04D 29/06*** | (2006.01) |
| ***F04D 29/041*** | (2006.01) |

(52) U.S. Cl.
CPC ..... *F04D 29/046* (2013.01); *F04D 29/048* (2013.01); *F04D 29/0413* (2013.01); *F04D 29/061* (2013.01); *F04D 29/2205* (2013.01); *F04D 29/426* (2013.01); *F04D 29/4266* (2013.01); *F04D 29/4273* (2013.01)

(58) Field of Classification Search
USPC ..... 417/420, 423.12
See application file for complete search history.

(56) References Cited

U.S. PATENT DOCUMENTS

| | | | | |
|---|---|---|---|---|
| 6,604,917 | B2 * | 8/2003 | Casper | F04D 13/0606 417/420 |
| 6,607,370 | B2 * | 8/2003 | Fukamachi | F04D 13/027 417/420 |
| 2014/0205480 | A1 | 7/2014 | Nakano | |

FOREIGN PATENT DOCUMENTS

| | | | |
|---|---|---|---|
| JP | S55-62659 | U1 | 4/1980 |
| JP | S56-163794 | A | 12/1981 |
| JP | H09-209981 | A | 8/1997 |
| JP | 2005-163678 | A | 6/2005 |
| JP | 2007-517162 | A | 6/2007 |

* cited by examiner

CENTRIFUGAL PUMP

TECHNICAL FIELD

Embodiments relate to a centrifugal pump to circulate the fluid in the closed circuit, for instance, refrigerant used for refrigerant circulation circuits such as air conditioners and freezers, and cooling water, etc. used for cooling circulation circuits for parts, apparatuses, etc. that generate heat.

BACKGROUND ART

FIG. 10 shows the vertical cross sectional view of such a conventional centrifugal pump.

As shown in FIG. 10, the conventional centrifugal pump 100 comprises a rotating blade member 102.

This rotating blade member 102 comprises a plurality of impeller members 106, which are radially extended toward the outer periphery, at an upper part of a circular tube bearing portion 104.

In addition, in the specification, the terms that indicate vertical directions, such as "upper side", "upper portion", "upper", "lower side", "lower portion", and "lower" indicate the vertical directions in each drawing.

The impeller member 106 includes abase end portion 108 which is extended upward from the bearing portion 104 toward the outer periphery, an enlarged diameter portion 110, which is enlarged upwardly in the direction of the outer periphery from this base end portion 108, and an outside blade portion 112, which is extended from this enlarged diameter portion 110 toward outer periphery.

Moreover, as for the rotating blade member 102, a rotor magnet 122, which includes a permanent magnet having an annular shape, is formed on the outer periphery of the base end portion 108.

Between the rotor magnet 122 and the impeller member 106, there is the structure that prevents the turn stop of the rotor magnet 122 and the fall of the rotor magnet 122 against the impeller member 106, by the screw member 240.

As a result, the impeller member 106 is rotated around an axial member 154 together with the rotor magnet 122.

Furthermore, as shown in FIG. 10, the centrifugal pump 100 includes a main body casing 124 in which the rotating blade member 102 is accommodated.

The main body casing 124 includes an upper main body casing 126.

The upper main body casing 126 comprises a top wall 128 and a side peripheral wall 130 which is downwardly extended from an outer periphery of the top wall 128.

On the side peripheral wall 130 of the upper main body casing 126, a suction side coupling member 132 (sucking side pipe) is fixed in a sealed state.

As a result, the suction side coupling member 132 is connected to the main body casing 124.

Moreover, on the side peripheral wall 130 of the upper main body casing 126, to oppose to the suction side coupling member 132, a discharge side coupling member 136 (discharge side pipe) is fixed in a sealed state.

As a result, the discharge side coupling member 136 is connected to the main body casing 124.

Moreover, as shown in FIG. 10, the main body casing 124 includes a lower main body casing 138 (rotor casing).

Moreover, on an inner wall of a lower end part 141 of the side peripheral wall 130 of the upper main body casing 126, an outer periphery flange 142 of the lower main body casing 138 is fixed in a sealed state.

As a result, in the main body casing 124, an interior space S1, which is surrounded with the upper main body casing 126 and the lower main body casing 138, is formed.

As shown in FIG. 10, this lower main body casing 138 includes a blade accommodating portion 144, which is extended horizontally from an outer periphery flange 142 of the lower main body casing 138 to inner periphery side, and a rotor magnet accommodating portion 146, which is extended downwardly from this blade accommodating portion 144.

In addition, under this rotor magnet accommodating portion 146, a lower bearing member accommodating portion 148, which is of cylindrical shape having a bottom, is formed.

Moreover, in the lower bearing member accommodating portion 148, a lower bearing member 150 is fitted by, for instance, press fit etc.

In a shaft hole 152 formed in this lower bearing member 150, a lower end portion 156 of an axial member 154 is fixed as pivoted.

Moreover, in the bearing portion 104 of this rotating blade member 102, the axial member 154 passes through so that the rotating blade member 102 can be rotated around the axial member 154.

In addition, the main body casing 124 is provided with a blade casing 158.

This blade casing 158, on the side of the suction side coupling member 132, an outer periphery flange 160 of this blade casing 158 is fixed in a sealed state under the side peripheral wall 130 of the upper main body casing 126.

On the other hand, as for the blade casing 158, an opening portion is formed to the side peripheral wall 162 on the side of the discharge side coupling member 136.

The periphery of the opening portion of this side peripheral wall 162 is fixed to the side peripheral wall 130 of the main body casing 124 in a sealed state together with the discharge side coupling member 136.

Moreover, the blade casing 158 includes a side peripheral wall 162, which is upwardly extended from the outer periphery flange 160, and an extending portion 164, which is extended in the horizontal direction from the side peripheral wall 162 along the outside blade portion 112 of the impeller member 106.

By having such shape, between the blade casing 158 and the blade accommodating portions 144 of the lower main body casing 138, the impeller member 106 can be accommodated.

Moreover, to a protruding portion 128*a*, which is projected downwardly to a central portion of the top wall 128 of the upper main body casing 126, an upper bearing member 168 is fixed by a fixing holder 161, so that it is protruded downwardly in an inner periphery opening portion 164*a* of an extending portion 164 of the blade casing 158.

On a shaft hole 170 formed in the upper bearing member 168, a top portion 172 of the axial member 154 that passes through an inside of the bearing portion 104 of the rotating blade member 102 is fixed as pivoted.

Moreover, by the blade casing 158, the interior space S1, which is formed by the upper main body casing 126 and the lower main body casing 138, is partitioned.

Consequently, a fluid introducing passage 174 is formed in the upper part.

Moreover, a rotating accommodating space S2, in which the rotating blade member 102 is accommodated, is formed in the lower part.

Moreover, as shown in FIG. 10, in the conventional centrifugal pump 100, a coil portion 204 is disposed on the outer periphery of the rotor magnet accommodating portion 146 of the lower main body casing 138 to be located on the periphery of the rotor magnet 122.

In addition, the coil portion 204 which rotates the rotating blade member 102 is provided.

As for the coil portion 204, a plurality of coils 210, which comprise a winding wire 208 rolled in a bobbin casing 206, are disposed in the circumferential direction at predetermined spaces.

In addition, these coils 210, in a coil cover main body 214 having the substantially cylindrical shape, are provided such that they are fitted to the outer periphery of the rotor magnet accommodating portion 146 of the lower main body casing 138 of the main body casing 124.

Moreover, as shown in FIG. 10, a main body casing side fixing bracket 186 is engaged with a coil side fixing protruded portion 216.

Consequently, the cover coil cover main body 214, in which the coil portion 204 is accommodated, can be provided detachably under the main body casing 124.

In addition, in FIG. 10, the reference numeral 226 indicates a connector, 228 indicates a lead line, and 230 indicates a magnetic pole sensor to detect the direction of the rotation and the position where the rotor magnet 122 is rotated.

In the conventional centrifugal pump 100 configured like this, the electric current flows through the coil 210 of the coil portion 204, so that the coil 210 is excited.

As a result, it effects on the rotor magnet 122 of the rotating blade member 102.

Consequently, the rotating blade member 102 can be rotated around the axial member 154, which passes through the bearing portion 104.

As a result, as shown by arrow N of FIG. 10, the fluid sucked from the suction side coupling member 132 passes from the fluid introducing passage 174, which is formed by the blade casing 158 and the upper main body casing 126, to the inner periphery opening portion 164*a* of the extending portion 164 of the blade casing 158.

Moreover, the fluid that passes through the inner periphery opening portion 164*a* is introduced into the rotating accommodating space S2, which is formed by the blade casing 158 and the lower main body casing 138.

In addition, by the turning force of the impeller member 106 of the rotating blade member 102, the fluid introduced into the rotating accommodating space S2 is discharged through the discharge side coupling member 136 from the rotating accommodating space S2 of the main body casing 124, as shown by arrow O of FIG. 10.

REFERENCE

Patent Document

[Patent Document 1]
JP H09 (1997)-209981, A

SUMMARY

Problems to be Solved

However, in such conventional centrifugal pump 100, a lower end portion 156 of an axial member 154 is fixed as pivoted at a shaft hole 152 formed in this lower bearing member 150.

Moreover, a top portion 172 of the axial member 154 is fixed as pivoted at a shaft hole 170 formed in the upper bearing member 168.

That is, the conventional centrifugal pump 100, is so-called of "both-end-fixed form".

Therefore, in such "both-end-fixed form", when both ends of the axial member 154 (the lower end portion 156 and the top portion 172) are fixed to the bearing member (the lower bearing member 150 and the upper bearing member 168) by pressing in for instance, there is a case that the concentricity of the bearing members might not be attained.

As a result, there is a case that the axial member 154 is inclined and fixed, so that the operation efficiency of the pump is decreased and careful care is necessary for assembly, and high precision level is demanded.

Moreover, such conventional centrifugal pump 100 is used for the system that assists cooling of heat generating parts, apparatuses, or the like by using the circulation of the fluid, for instance.

In addition, there is a case in which it is used for not only the industrial use but also home apparatus (consumer electronics) according to the usage of the system that is built in.

Recently, as for home apparatus, the miniaturization and noise reduction are advanced.

In order to achieve this, a similar specification is required about the pump in which circulation of fluid is performed.

However, in such conventional centrifugal pump 100, as shown in FIG. 10, an upper bearing member 168 is fixed by a fixing holder 161, so that it is protruded downwardly in an inner periphery opening portion 164*a* of an extending portion 164 of the blade casing 158.

Therefore, as shown in FIG. 10, the fixing holder 161, which is this shaft fitting part, is located in the center section of the inner periphery opening portion 164*a* of the extending portion 164 of the blade casing 158.

Therefore, as shown by arrow P of FIG. 10 and arrow Q of FIG. 11, the fluid sucked from the suction side coupling member 132 passes from the fluid introducing passage 174 to the inner periphery opening portion 164*a* of the extending portion 164 of the blade casing 158.

As a result, when the fluid is introduced into the rotating accommodating space S2, the fluid is collided with the fixing holder 161 which is the shaft fitting part.

As a result, the loss is caused in the fluid flow, the fluid is not introduced into rotating accommodating space S2 smoothly, and the pumping efficiency is decreased.

Moreover, such collision to the fixing holder 161 which is a shaft fitting part is a factor of generating the noise such as an abnormal sound, and moreover, the durability becomes inferior.

Therefore, in Patent Document 1 (JP H09-209981, A), the structure of the circulation type pump to suppress the pump operation sound caused by the disorder of the flow of pumping is proposed.

That is, in the circulation type pump 300 of Patent Document 1, as shown in the partially enlarged cross sectional view of FIG. 12, a thrust pad member 308 to fix a bearing 302 to a bearing holding portion 306 of a cover 304, is provided.

In addition, this thrust pad member 308, as shown by arrow J of FIG. 12, includes an inclination surface 310 having a shape formed by shaving off the ridge line from the outer periphery surface of the bearing holding portion 306.

By the configuration like this, the disorder of the flow of pumping is prevented and the fluid is introduced into a pump station 312 smoothly.

As a result, it is proposed that noise in pump operation due to disorder of pumping is prevented.

However, in the circulation type pump 300 of this Patent Document 1, as well as the conventional centrifugal pump 100 of above-mentioned FIG. 10 and FIG. 11, collision of the fluid introduced from an introducing passage 314 with the bearing holding portion 306 cannot be avoided.

As a result, the loss is caused in the fluid flow, and the pumping efficiency is decreased.

Moreover, it becomes the factor of generating the noise such as an abnormal sound, and the durability becomes inferior.

Considering such a current state, a centrifugal pump, in which the pressure loss is not caused in the fluid flow, in which the pumping efficiency is not decreased, in which the noise such as an abnormal sound, is not generated, in which the durability and quietness are superior, and in which the predetermined objective pump performance can be retained, is provided.

Solution to Problem

A centrifugal pump comprises: a rotating blade member including an impeller member and a rotor magnet associated with the impeller member, a main body casing in which the rotating blade member is accommodated, and a coil portion, that rotates the rotating blade member, wherein the coil portion is located on a periphery of the rotor magnet, an axial member which is associated with the main body casing, wherein the rotating blade member pivots around the axial member, wherein the axial member includes an end portion at an axial rotor magnet side, and the axial member is fixed at the end portion in the main body casing, the main body casing forms a fluid introducing passage, and is associated with a blade casing in which the rotating blade member is accommodated, an end portion of a bearing portion of the impeller at an axial fluid introducing passage side is protruded such that the end portion of the bearing portion protrudes from an inner periphery opening portion of the blade casing into the fluid introducing passage.

In the centrifugal pump, the axial member is fixed at the end portion at the axial rotor magnet side in the main body casing.

As a result, the axial member is not fixed at opposite side of the axial end portion at the rotor magnet side in the main body casing, and it is so-called "cantilever form".

Therefore, the axial member might not be inclined and fixed.

As a result, the operation efficiency of the pump is not decreased, and careful care on assembly is unnecessary, and the precision level is not demanded.

Moreover, the end portion of the bearing portion of the impeller member at the axial fluid introducing passage side is protruded such that it protrudes from the inner periphery opening portion of the blade casing into the fluid introducing passage, and it is so-called "cantilever form".

Therefore, the shaft fitting part does not exist, like the conventional so-called "both-end-fixed form," in the inner periphery opening portion of the blade casing.

Therefore, as conventional, the pressure loss due to the collision of the fluid to the shaft fitting part is not caused in the fluid flow.

As a result, the pumping efficiency is not decreased, the noise such as an abnormal sound is not generated, the durability and quietness are superior, and the predetermined objective pump performance can be retained.

Moreover, the centrifugal pump is characterized in that a bearing portion of the impeller member is rotated together with the impeller member.

By the configuration like this, the end portion of the bearing portion of the impeller member at the axial fluid introducing passage side, which protrudes from the inner periphery opening portion of the blade casing into the fluid introducing passage, is rotated together with the impeller member.

Therefore, when fluid passes from the fluid introducing passage through the inner periphery opening portion of the blade casing and is introduced into the rotating accommodating space, the edge on the axial fluid introducing passage side of the bearing portion, which is rotated together with this impeller member, is rotated.

As a result, the rotational flow (rectification) is generated by this rotation, so that it is smoothly introduced into the rotating accommodating space.

Moreover, the centrifugal pump of the invention is characterized in that the bearing portion of the impeller member is integrally formed with the impeller member.

The bearing portion of the impeller member, for instance, is composed of the same member as the impeller member, or for instance, it may be formed integrally by integrally molding the metal in the plastic.

By composing like this, the edge on the axial fluid introducing passage side of the bearing portion of the impeller member is rotated together with the impeller member.

As a result, an end portion of the bearing portion, which protrudes from the inner periphery opening portion of the blade casing into the fluid introducing passage, of the impeller member, at a side of the axial fluid introducing passage, is rotated together with the impeller member.

Therefore, when fluid passes from the fluid introducing passage through the inner periphery opening portion of the blade casing and is introduced into the rotating accommodating space, the axial end portion of the bearing portion, which is rotated together with this impeller member, at a fluid introducing passage side of, is rotated.

As a result, the rotational flow (rectification) is generated by this rotation, so that it is smoothly introduced into the rotating accommodating space.

Moreover, the centrifugal pump is characterized in that, at the end portion of the bearing portion of the impeller member at the axial fluid introducing passage side, a taper guide face is formed, wherein the taper guide face guides, from the inner periphery opening portion of the blade casing to the rotating accommodating space that accommodates the rotating blade member, the fluid introduced from the fluid introducing passage, and is inclined from the outside diameter side to the inside diameter side.

By the configuration like this, at the end portion of the bearing portion of the impeller member at the axial fluid introducing passage side, a taper guide face, which is inclined from the outside diameter side to the inside diameter side, is formed.

As a result, the fluid introduced from the fluid introducing passage can be smoothly guided from the inner periphery opening portion of the blade casing to the rotating accommodating space that accommodates the rotating blade member.

Moreover, the centrifugal pump is characterized in that, on the outer periphery of the end portion of the bearing portion of the impeller member at the axial fluid introducing passage side, a protruding portion, which is protruded in the direction of the outside diameter, is formed.

As a result, the end portion of the bearing portion of the impeller member at the axial fluid introducing passage side protrudes to the fluid introducing passage, and is rotated together with this protruding portion.

Consequently, when fluid passes from the fluid introducing passage through the inner periphery opening portion of the blade casing and is introduced into the rotating accommodating space, a rotational flow is generated by the rotation of this protruding portion.

As a result, fluid can be more smoothly introduced into the rotating accommodating space.

Moreover, the centrifugal pump is characterized in that, the end portion of the bearing portion of the impeller member at the axial fluid introducing passage side is formed such that the axial member is covered.

Like this, the end portion of the bearing portion of the impeller member at the axial fluid introducing passage side is formed such that the axial member is covered.

As a result, since the axial member is not exposed, when fluid is passes from the fluid introducing passage through the inner periphery opening portion of the blade casing and is introduced into the rotating accommodating space, the rotation of the portion, in which this axial member is not exposed, is added.

As a result, fluid can be more smoothly introduced into the rotating accommodating space.

In addition, the end portion of the bearing portion of the impeller member at the axial fluid introducing passage side is formed such that the axial member is covered.

As a result, the resistance of the fluid can be reduced, the pressure loss is never caused in the fluid flow, and the pumping efficiency is not decreased.

In addition, the end portion of the bearing portion of the impeller member at the axial fluid introducing passage side is formed such that the axial member is covered.

As a result, the foreign matter in the fluid is not invaded into the clearance between the axial member and the bearing portion of the impeller member, the impeller member is rotated smoothly, and the pumping efficiency is not decreased.

Moreover, the centrifugal pump is characterized in that, on the opening edge of the inner periphery opening portion of the blade casing, a guide protruding portion which is protruded to the rotating accommodating space side is formed, wherein the fluid introduced from the fluid introducing passage is guided from the inner periphery opening portion of the blade casing to the rotating accommodating space that accommodates the rotating blade member.

Thus, on the opening edge of the inner periphery opening portion of the blade casing, the guide protruding portion which is protruded to the rotating accommodating space side is formed.

As a result, the fluid introduced from the fluid introducing passage can be smoothly guided and introduced from the inner periphery opening portion of the blade casing to the rotating accommodating space that accommodates the rotating blade member.

Moreover, by rotation of the guide protruding portion which is protruded to the rotating accommodating space side, the fluid introduced from the fluid introducing passage can be smoothly introduced into the rotating accommodating space that accommodates the rotating blade member.

Moreover, the centrifugal pump is characterized in that, the end portion of the bearing portion of the impeller member at the axial fluid introducing passage side is extended such that it touches the main body casing and forms a rotation sliding portion.

As a result, the end portion of the bearing portion of the impeller member at the axial fluid introducing passage side is supported by the rotation sliding portion.

Consequently, the axial member is not inclined (does not swing), the above-mentioned rotational flow (rectification) is surely generated.

Therefore, the fluid introduced from the fluid introducing passage can be smoothly guided and introduced from the inner periphery opening portion of the blade casing to the rotating accommodating space that accommodates the rotating blade member.

Moreover, the centrifugal pump is characterized in that, the axial member is fixed directly at end portion of the axial member in the axial direction at the axial rotor magnet side in the main body casing.

Thus, the axial member is fixed directly at end portion of the axial member in the axial direction at the axial rotor magnet side in the main body casing.

As a result, the axial member is not inclined (does not swing), the above-mentioned rotational flow (rectification) is surely generated.

Consequently, the fluid introduced from the fluid introducing passage can be smoothly guided and introduced from the inner periphery opening portion of the blade casing to the rotating accommodating space that accommodates the rotating blade member.

Moreover, the centrifugal pump is characterized in that, an axial distance H1 between an end of the bearing portion of the impeller member at the axial fluid introducing passage side and the main body casing, and an axial distance H2 between an end of the blade portion of the impeller member at the axial fluid introducing passage side and the blade casing, are set as the relation of $H1<H2$.

By the configuration like this, even if the impeller member is moved axially by any chance, and the end portion of the bearing portion of the impeller member the axial fluid introducing passage side touches the main body casing, the end portion of the bearing portion of the impeller member at the axial fluid introducing passage side does not touch the blade casing.

As a result, the wear-out and the breakage and the damage of the impeller member are not caused.

Moreover, the pumping efficiency is not decreased, and the noise such as an abnormal sound is not generated, and the durability and quietness are superior.

Advantageous Effects

According to the embodiments, the axial member is fixed at the end portion of the axial member at the axial rotor magnet side in the main body casing.

As a result, the axial member is not fixed at opposite side of the axial end portion of the axial member at the rotor magnet side in the main body casing, and it is so-called "cantilever form".

Therefore, the axial member might not be inclined and fixed.

As a result, the operation efficiency of the pump is not decreased, and careful care on assembly is unnecessary, and high precision level is not demanded.

Moreover, the end portion of the bearing portion of the impeller member at the axial fluid introducing passage side is protruded such that it protrudes from the inner periphery opening portion of the blade casing into the fluid introducing passage, and it is so-called "cantilever form".

Therefore, the shaft fitting part does not exist like the conventional so-called "both-end-fixed form" in the inner periphery opening portion of the blade casing.

Therefore, as conventional, the pressure loss due to collision of the fluid to the shaft fitting part is not caused in the fluid flow.

As a result, the pumping efficiency is not decreased, the noise such as an abnormal sound is not generated, the durability and quietness are superior, and the predetermined objective pump performance can be retained.

DESCRIPTION OF EMBODIMENTS

Figure 1:
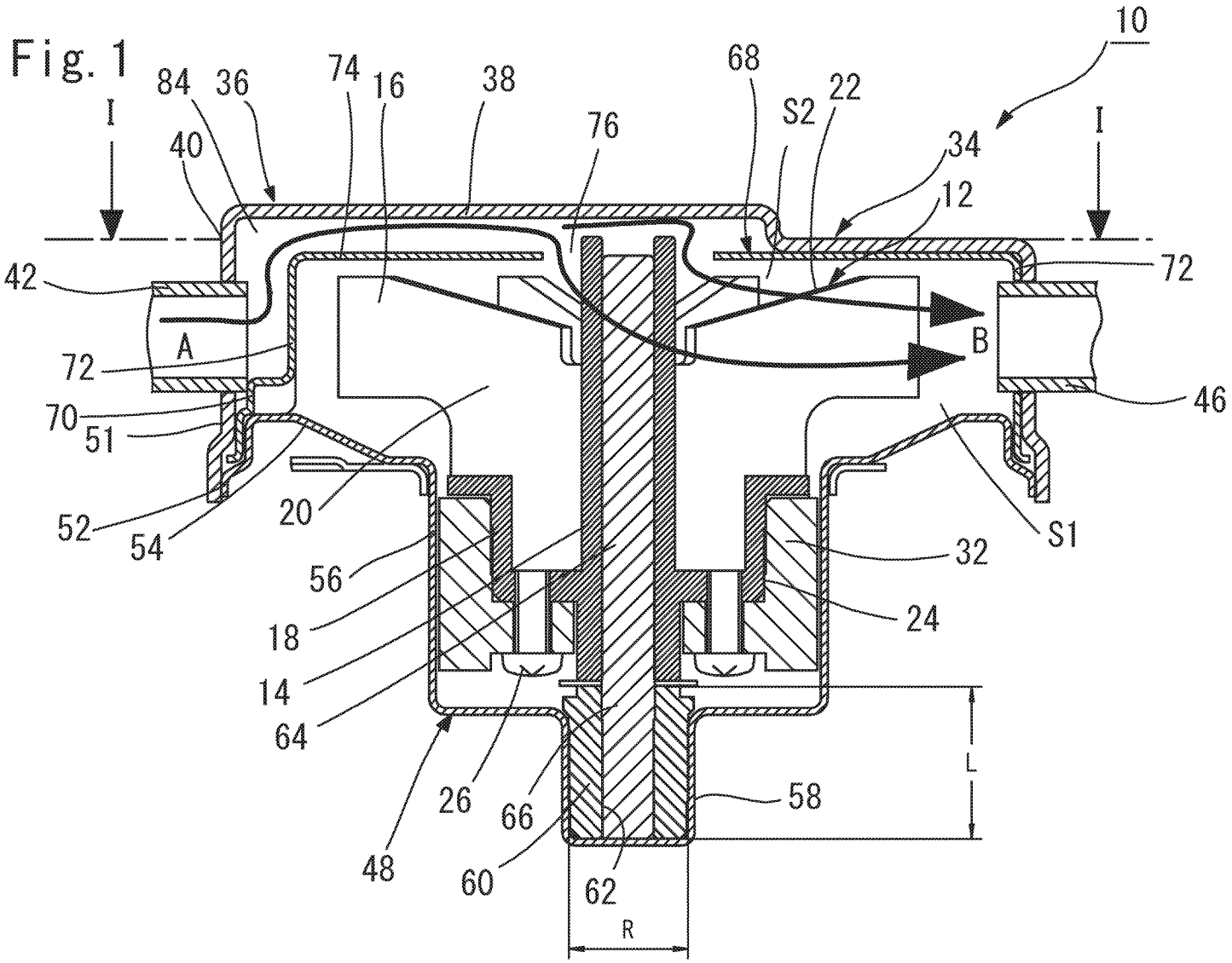
FIG. 1 is a vertical cross sectional view of the centrifugal pump.

Hereafter, embodiments are described in the detail or more on the basis of the drawing.

Embodiment 1

FIG. 1 is a vertical cross sectional view of the centrifugal pump

Figure 2:
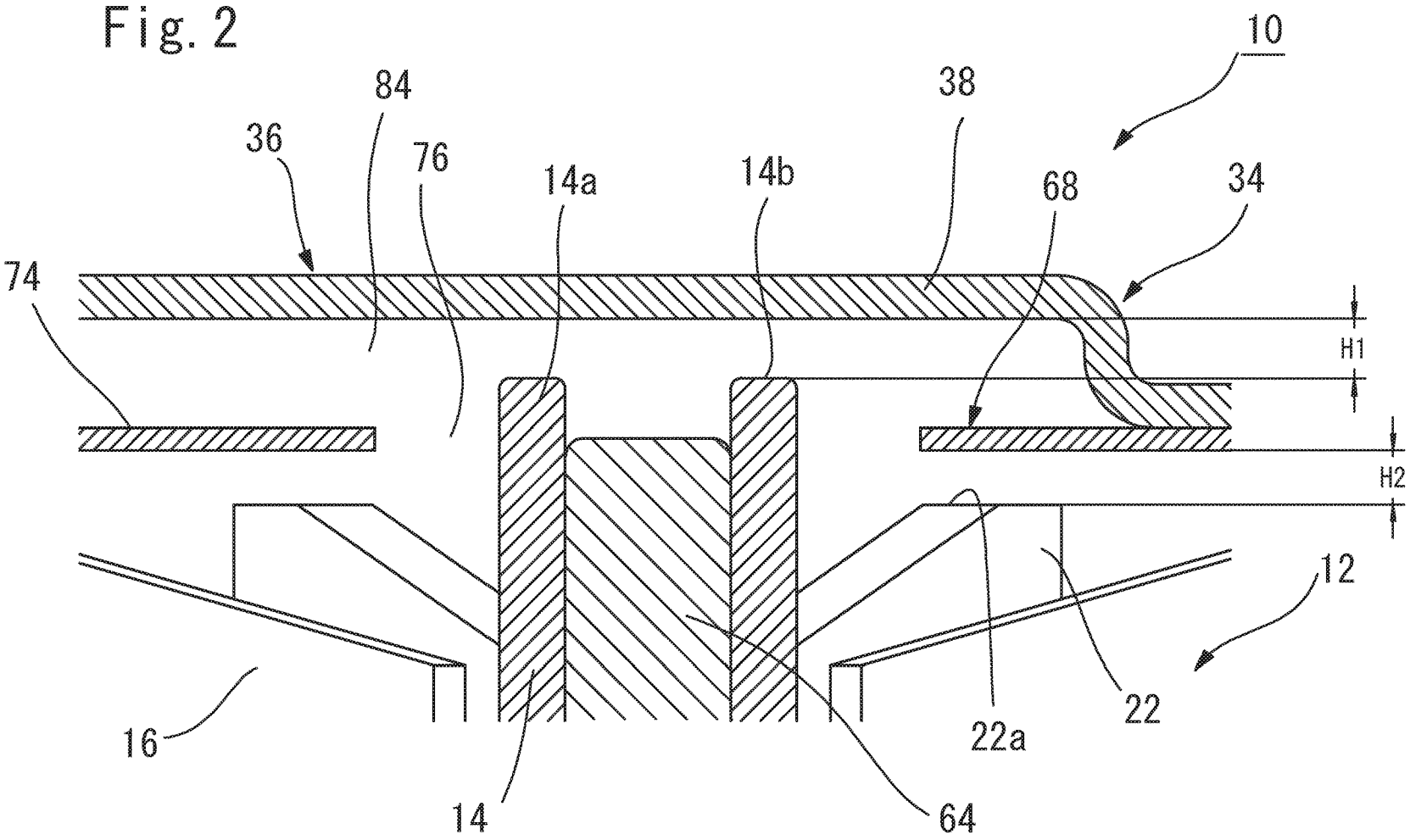
FIG. 2 is a partially enlarged cross sectional view of FIG. 1.

FIG. 2 is a partially enlarged cross sectional view of FIG. 1.

Figure 3:
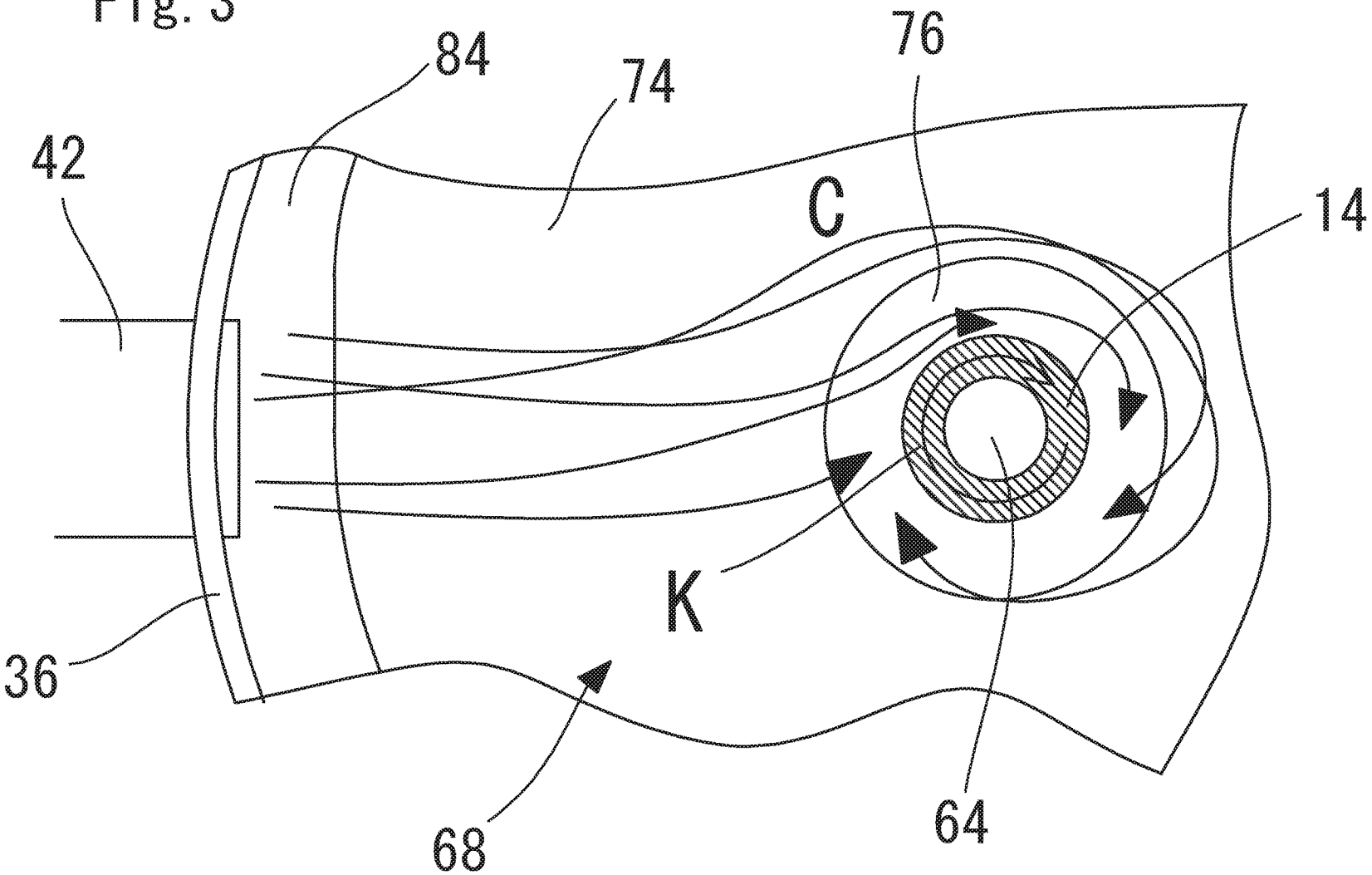
FIG. 3 is a partially enlarged cross sectional view in I-I line in FIG. 1, in which the fluid flow of the centrifugal pump is shown.

FIG. 3 is a partially enlarged cross sectional view in I-I line in FIG. 1, in which the fluid flow of the centrifugal pump is shown.

In FIG. 1, reference numeral 10 indicates a centrifugal pump as a whole.

Figure 10:
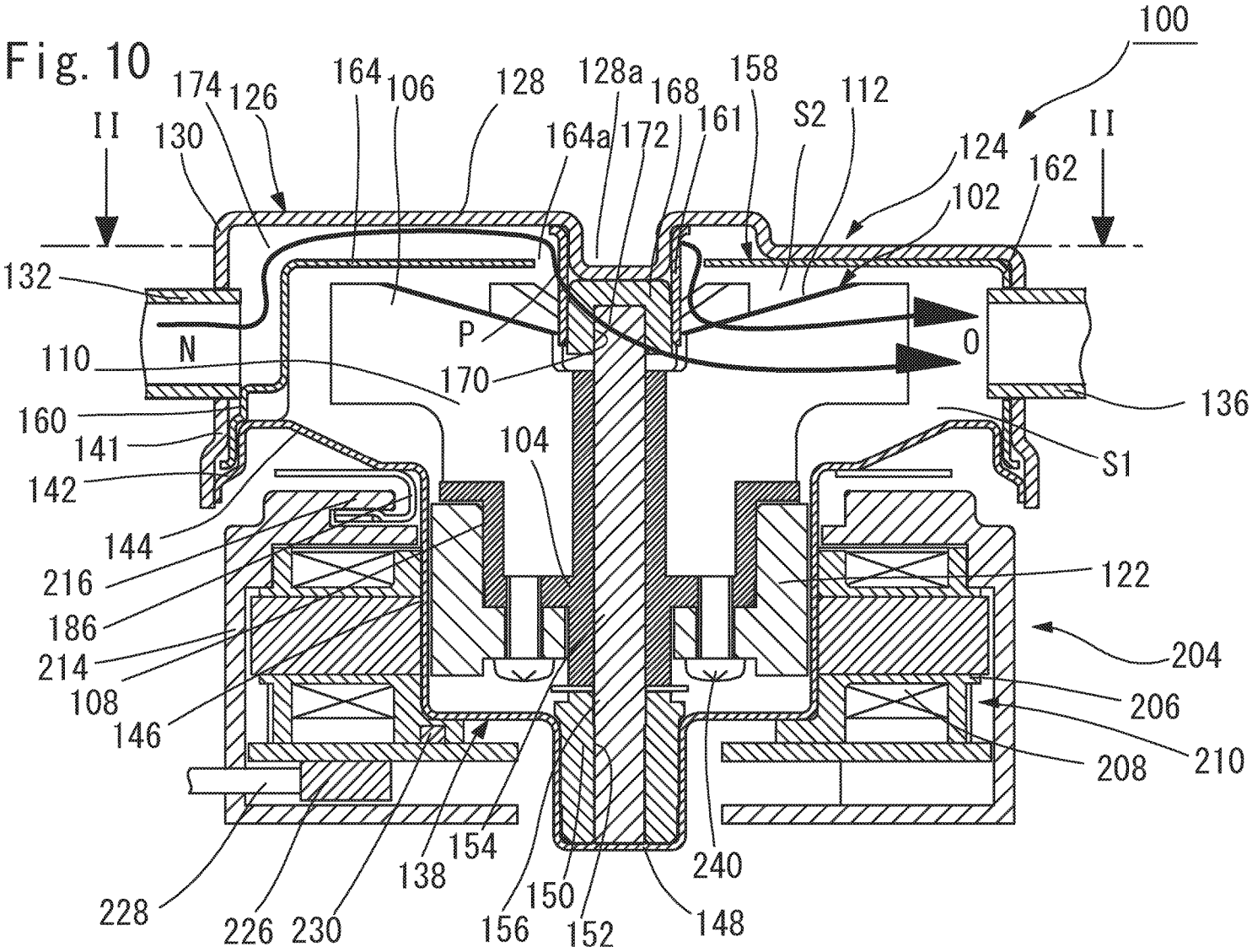
FIG. 10 is a vertical cross sectional view of the conventional centrifugal pump.

In the centrifugal pump 10 of FIG. 1, for convenience sake of clarification, the composition member such as the coil portion 204, which is located on the periphery of the rotor magnet 122, as described in the conventional centrifugal pump 100 shown in FIG. 10, and is disposed on the outer periphery of the rotor magnet accommodating portion 146 of the lower main body casing 138, and rotates the rotating blade member 102, is omitted and shown in the drawing.

As shown in FIG. 1, the centrifugal pump 10 comprises a rotating blade member 12.

This rotating blade member 12 comprises a plurality of impeller members 16, which are radially extended toward the outer periphery at an upper part of a circular tube bearing portion 14.

In addition, the number of impeller members 16 may be elected according to the usage of centrifugal pump 10 and the pump ability that is required, and is not limited particularly.

As shown in FIG. 1, the impeller member 16 includes a base end portion 18 which is extended toward the outer periphery of the bearing portion 14, an enlarged diameter portion 20, which is enlarged upwardly toward the outer periphery from this base end portion 18, and an outside blade portion 22, which is extended from this enlarged diameter portion 20 toward the outer periphery.

By forming the shape of the impeller member 16 like this shape, the discharge ability can be improved by the outside blade portion 22's function caused by rotation of the impeller member 16.

Moreover, on the rotating blade member 12, a rotor magnet accommodating portion 24, which is extended toward the outer periphery, is formed under the bearing portion 14.

In addition, a rotor magnet 32, which includes an annular permanent magnet, is fitted to the rotor magnet accommodating portion 24.

Moreover, as for this rotor magnet 32, by means of a screw member 26, as a dropout preventing means to prevent the impeller member 16 and the rotor magnet 32 from dropping out, the turn stop of the rotor magnet 32 and the fall of the rotor magnet 32 are prevented against the impeller member 16.

Consequently, the impeller member 16 is rotated around an axial member 64 together with the rotor magnet 32.

In this Embodiment, the rotor magnet 32 is fixed to the impeller member 16 by the screw member 26, as a dropout preventing means to prevent the impeller member 16 and the rotor magnet 32 from dropping out.

However, the fixing method is not limited to this.

Furthermore, as shown in FIG. 1, the centrifugal pump 10 includes a main body casing 34 in which the rotating blade member 12 is accommodated.

The main body casing 34 includes an upper main body casing 36.

The upper main body casing 36 comprises a top wall 38 and a side peripheral wall 40 which is downwardly extended from an outer periphery of the top wall 38.

Moreover, as shown in FIG. 1, at the side peripheral wall 40 of the upper main body casing 36, an opening portion to fix a suction side coupling member 42 is formed.

As shown in FIG. 1, the suction side coupling member 42 is fixed to the opening portion in a sealed state with, for instance, the welding, the soldering, the adhesion, etc.

As a result, the suction side coupling member 42 is connected to the main body casing 34.

At the side peripheral wall 40 of the upper main body casing 36, an opening portion to fix a discharge side coupling member 46 is formed.

As shown in FIG. 1, at this opening portion, the discharge side coupling member 46 is fixed in a sealed state with, for instance, the welding, the brazing, the adhesion, etc.

As a result, the discharge side coupling member 46 is connected to the main body casing 34.

Moreover, as shown in FIG. 1, the main body casing 34 includes a lower main body casing 48.

Moreover, on an inner wall of a lower end part 51 of the side peripheral wall 40 of the upper main body casing 36, an outer periphery flange 52 of the lower main body casing 48 is fixed in a sealed state with, for instance, the welding, the brazing, the adhesion, etc.

As a result, in the main body casing 34, an interior space S1, which is surrounded with the upper main body casing 36 and the lower main body casing 48, is formed.

As shown in FIG. 1, this lower main body casing 48 includes a blade accommodating portion 54, which is extended horizontally from an outer periphery flange 52 of the lower main body casing 48 to inner periphery side, and a rotor magnet accommodating portion 56, which is extended downwardly from this blade accommodating portion 54.

In addition, under this rotor magnet accommodating portion 56, a lower bearing member accommodating portion 58, is of a cylindrical shape having a bottom, is formed.

Moreover, in the lower bearing member accommodating portion 58, a lower bearing member 60 is fitted by, for instance, press fit, etc.

In a shaft hole 62 formed in this lower bearing member 60, a lower end portion 66 of an axial member 64 is fixed as pivoted by, for instance, press fit, etc.

In this case, as shown in FIG. 1, it is desirable that depth L of the shaft hole 62 formed in the lower bearing member 60 (that is, fixed length) is larger than R where R is the outer diameter of the lower bearing member 60.

By setting the depth L of the shaft hole 62 (that is, the fixed length) like this, strength is attained, the concentricity of the axial member 64 is attained, and the axial member 64 is not inclined (does not swing).

Consequently, the above-mentioned rotational flow (rectification) is surely generated.

As a result, the fluid introduced from the fluid introducing passage 84 can be smoothly guided and introduced from the inner periphery opening portion 76 of the blade casing 68 to the rotating accommodating space (the interior space S1 and the rotating accommodating space S2) that accommodates the rotating blade member 12.

Moreover, in the bearing portion 14 of this rotating blade member 12, the axial member 64 passes through so that the rotating blade member 12 can be rotated around the axial member 64.

In addition, as shown in FIG. 1, the main body casing 34 is provided with a blade casing 68.

An outer periphery flange 70 of this blade casing 68 is fixed in a sealed state with, for instance, the welding, the brazing, and adhesion, as sandwiched between a lower end part 51 of the upper main body casing 36 and an outer periphery flange 52 of the lower main body casing 48.

Moreover, the blade casing 68 includes a side peripheral wall 72, which is upwardly extended from the outer periphery flange 70, and an extending portion 74, which is extended inwardly in the horizontal direction from the side peripheral wall 72 along the outside blade portion 22 of the impeller member 16.

By having such a shape, between the blade accommodating portions 54 of the blade casing 68 and the lower main body casing 48, the impeller member 16 can be accommodated.

Moreover, as shown in FIG. 1, the diameter of the side peripheral wall 72 of the blade casing 68 is formed smaller than the diameter of the side peripheral wall 40 of the upper main body casing 36.

In addition, the height of the side peripheral wall 72 of the blade casing 68 is formed smaller than the height of the side peripheral wall 40 of the upper main body casing 36.

As a result, by the blade casing 68, the interior space S1, which is formed by the upper main body casing 36 and the lower main body casing 48 is partitioned.

Consequently, a fluid introducing passage 84 is formed in the upper part.

Moreover, a rotating accommodating space S2, in which the rotating blade member 12 is accommodated, is formed in the lower part.

The centrifugal pump 10 configured like this is operated as follows.

First of all, the electric current is flowed through the coil 210 of the coil portion 204, so that the coil 210 is excited.

As a result, it effects on the rotor magnet 32 of the rotating blade member 12.

Consequently, the rotating blade member 12 can be rotated around the axial member 64, which passes through the bearing portion 14.

As a result, the rotating blade member 12 is rotated.

Consequently, as shown by arrow A of FIG. 1, the fluid sucked from the suction side coupling member 42 passes from the fluid introducing passage 84, which is formed by the blade casing 68 and the upper main body casing 36, to the inner periphery opening portion 76 of the extending portion 74 of the blade casing 68.

Moreover, the fluid that passes through the inner periphery opening portion 76 is introduced into the rotating accommodating space S2, which is formed by the blade casing 68 and the lower main body casing 48.

In addition, by the turning force of the impeller member 16 of the rotating blade member 12, as shown by arrow B of FIG. 1, the fluid introduced into the rotating accommodating space S2 is discharged through the discharge side coupling member 46 from the rotating accommodating space S2 of the main body casing 34.

Figure 11:
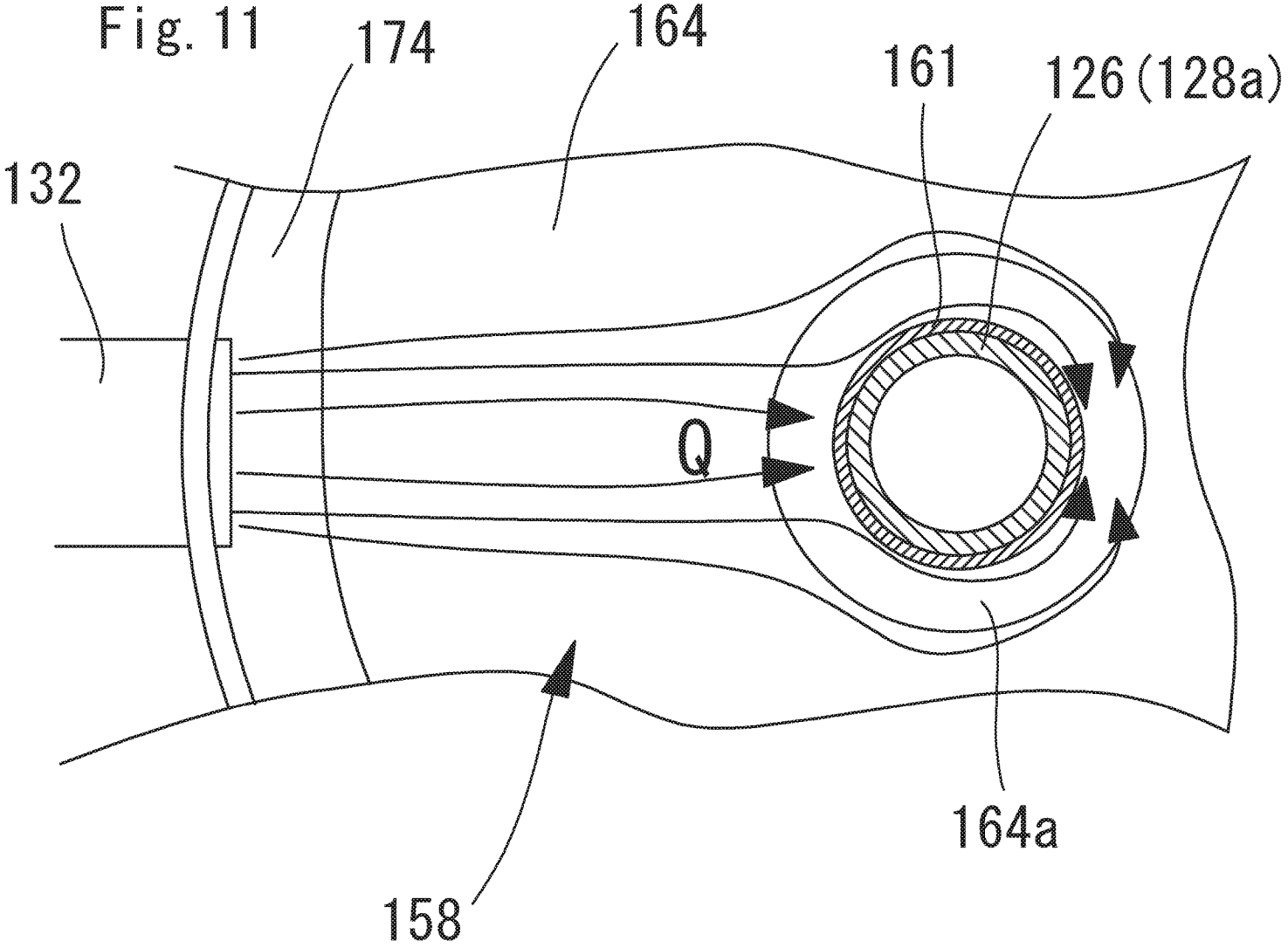
FIG. 11 is a partially enlarged cross sectional view in the state of notch partially in the II-II line of the conventional centrifugal pump.
Figure 12:
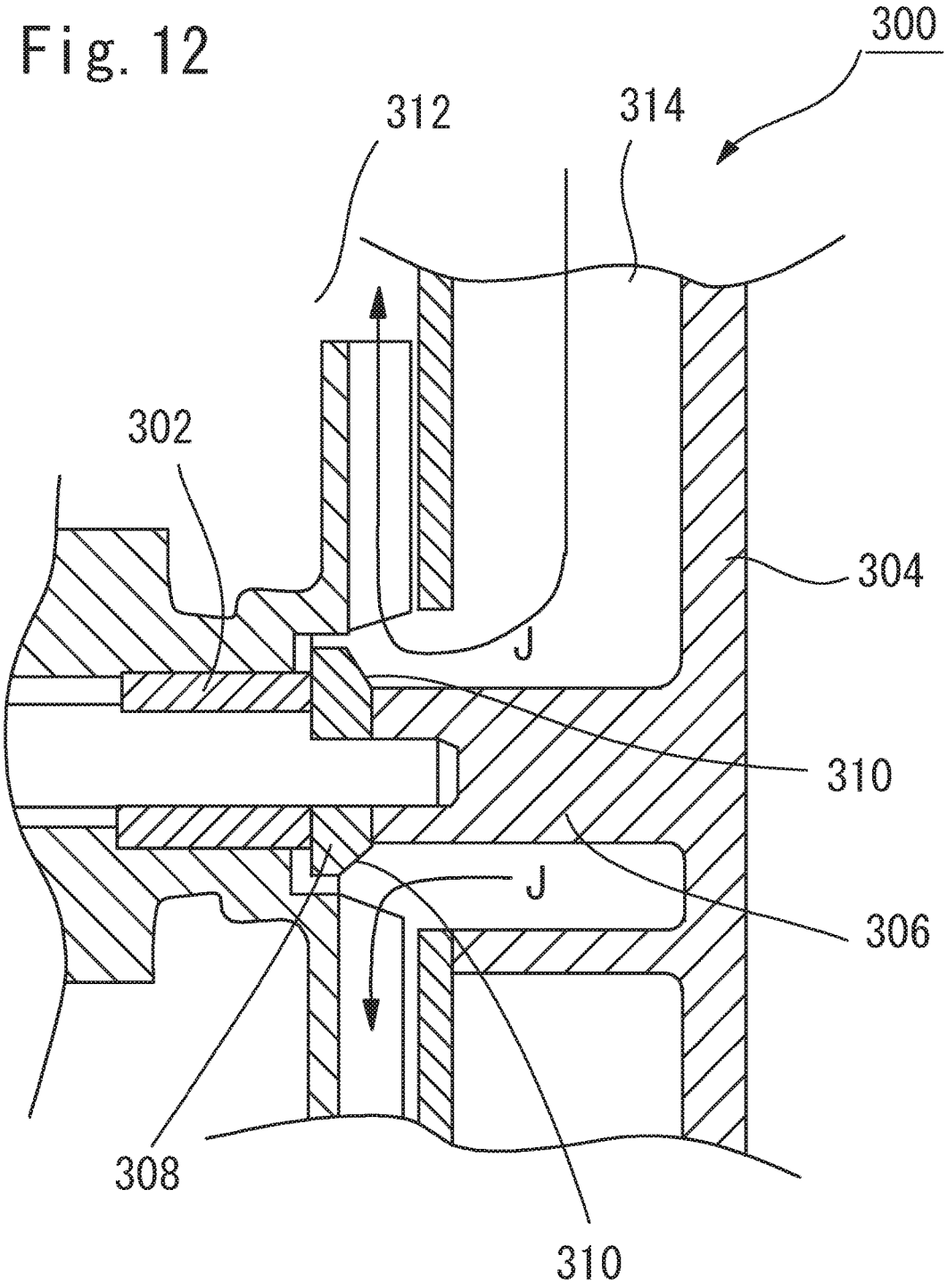
FIG. 12 is a partially enlarged cross sectional view of the circulation type pump of Patent Document 1.

By the way, in the conventional centrifugal pump 100 as shown in FIG. 10 and FIG. 11, in a shaft hole 152 formed in this lower bearing member 150, a lower end portion 156 of an axial member 154 is fixed as pivoted.

Moreover, in a shaft hole 170 formed in the upper bearing member 168, a top portion 172 of the axial member 154 is fixed as pivoted.

That is, in the conventional centrifugal pump 100, it is so-called of "both-end-fixed form".

Therefore, in such "both-end-fixed form", when both end portions of the axial member 154 (the lower end portion 156 and the top portion 172) are fixed to the bearing members (the lower bearing member 150 and the upper bearing member 168) by pressing in, for instance, there is a case that the concentricity of the bearing members might not be attained.

As a result, there is a case that the axial member 154 is inclined and fixed, so that the operation efficiency of the pump is decreased and careful care is necessary for assembly, and high precision level is demanded.

Therefore, in the centrifugal pump 10, the upper bearing member 168 like conventional centrifugal pump 100 is not provided.

In addition, as shown in FIG. 1 and FIG. 2, the top portion of the axial member 64 is not pivoted.

Moreover, the axial member 64 is fixed to the lower bearing member accommodating portion 58 of the main body casing 34 by the lower bearing member 60.

That is, the axial member 64 is fixed at its end portion at a side of the axial rotor magnet 32 and it is so-called "cantilever form".

Therefore, the axial member 64 might not be inclined and fixed.

As a result, the operation efficiency of the pump is not decreased, and careful care on assembly is unnecessary, and high precision level is not demanded.

Moreover, in the centrifugal pump 10 of this Embodiment, an end portion of an axial fluid introducing passage 84 at an axial direction of the bearing portion 14 of the impeller member 16, that is, a top portion 14*a* of the bearing portion 14, protrudes such that it protrudes upwardly from the inner periphery opening portion 76 of the extending portion 74 of the blade casing 68 into the fluid introducing passage 84.

Therefore, since it is so-called "cantilever form", the shaft fitting part does not exist like the conventional, so-called, "both-end-fixed form" in the inner periphery opening portion of the blade casing.

As a result, as conventional, the pressure loss due to the collision of the fluid to the shaft fitting part is not caused in the fluid flow.

As a result, the pumping efficiency is not decreased, the noise such as an abnormal sound is not generated, the durability and quietness are superior, and the predetermined objective pump performance can be retained.

Moreover, by the configuration like this, as shown by arrow C of FIG. 3, the rotating blade member 12 is rotated.

As a result, the fluid sucked from the suction side coupling member 42 passes from the fluid introducing passage 84, which is formed by the blade casing 68 and the upper main body casing 36, to the inner periphery opening portion 76 of the extending portion 74 of the blade casing 68.

At this time, the fluid is along (for instance, rotation of the direction of arrow K of FIG. 3) with a rotational movement of the top portion 14*a* of the impeller member 16.

Consequently, it becomes a rotational flow (rectification) by this rotation (see arrow C of FIG. 3).

As a result, through the inner periphery opening portion 76 that is the inflow port, it becomes easy to enter into the inner space S1 and the rotating accommodating space S2 smoothly.

As a result, the pressure loss can be reduced.

Therefore, the pumping efficiency is not decreased, the noise such as an abnormal sound is not generated, the durability and quietness are superior, and the predetermined objective pump performance can be retained.

In this case, as mentioned above, the bearing portion 14 of the impeller member 16 is rotated together with the impeller member 16.

By the configuration like this, an end portion of the bearing portion 14, which protrudes from the inner periphery opening portion 76 of the blade casing 68 into the fluid introducing passage 84, of the impeller member 16, at a side of the axial fluid introducing passage 84, that is, the top portion 14*a* of the bearing portion 14, is rotated together with the impeller member 16.

Therefore, when fluid passes from the fluid introducing passage 84 through the inner periphery opening portion 76 of the blade casing 68 and is introduced into the rotating accommodating space S2, the end portion of the bearing portion 14, at a side of the axial fluid introducing passage 84, i.e., a portion rotated together with this impeller member 16, that is, the top portion 14*a* of the bearing portion 14, is rotated.

As a result, the rotational flow (rectification) is generated by this rotation, so that it is smoothly introduced into the rotating accommodating space S2.

Moreover, in this case, it is desirable that the bearing portion 14 of the impeller member 16 is integrally formed with the impeller member 16.

The bearing portion 14 of the impeller member 16, for instance, is composed of the same member as the impeller member 16, or for instance, it may be formed integrally by integrally molding the metal in the plastic.

Of course, the bearing portion 14 and the impeller member 16 may be made of one part.

By the configuration like this, the end portion of the bearing portion 14 of the impeller member 16 at the axial fluid introducing passage 84 side, that is, the top portion 14*a* of the bearing portion 14, is rotated together with the impeller member 16.

Moreover, in this Embodiment, the impeller member 16 and the bearing portion 14 are integrally formed by integrally molding by the plastic.

However, it is not limited to this in any way, and the material having a good slidability is selected appropriately for axial member 64.

As a result, the bearing portion 14 of the impeller member 16 may be formed integrally with the impeller member 16.

As a result, an end portion of the bearing portion 14, which protrudes from the inner periphery opening portion 76 of the blade casing 68 to the fluid introducing passage 84, of the impeller member 16, at a side of the axial fluid introducing passage 84, that is, the top portion 14*a* of the bearing portion 14, is rotated together with the impeller member 16.

Therefore, when fluid passes from the fluid introducing passage 84 through the inner periphery opening portion 76 of the blade casing 68 and is introduced into the rotating accommodating space S2, the end portion of the bearing portion 14, at a side of the axial fluid introducing passage 84, i.e., a portion rotated together with this impeller member 16, that is, the top portion 14*a* of the bearing portion 14, is rotated.

As a result, the rotational flow (rectification) is generated by this rotation, so that it is smoothly introduced into the rotating accommodating space S2.

In addition, in the centrifugal pump 10 of this Embodiment, as shown in FIG. 2, an axial distance H1 between the end 14*b* at the axial fluid introducing passage 84 side of the bearing portion 14 of the impeller member 16 and the main body casing 34, an axial distance H2 between the end 22*a* at the axial fluid introducing passage 84 side of the blade portion 22 of the impeller member 16 and the blade casing 68, are set as the relation of H1<H2.

By the configuration like this, even if the impeller member 16 is moved axially by any chance, and the end 14*b* at the axial fluid introducing passage 84 side of the bearing portion 14 of the impeller member 16 touches the main body casing 34, the end 22*a* on the axial fluid introducing passage 84 side of the outside blade portion 22 of the impeller member 16 does not touch the blade casing 68.

As a result, the wear-out and the breakage and the damage of the impeller member 16 (the outside blade portion 22) are not caused.

Moreover, the pumping efficiency is not decreased, and the noise such as an abnormal sound is not generated, and the durability and quietness are superior.

Embodiment 2

Figure 4:
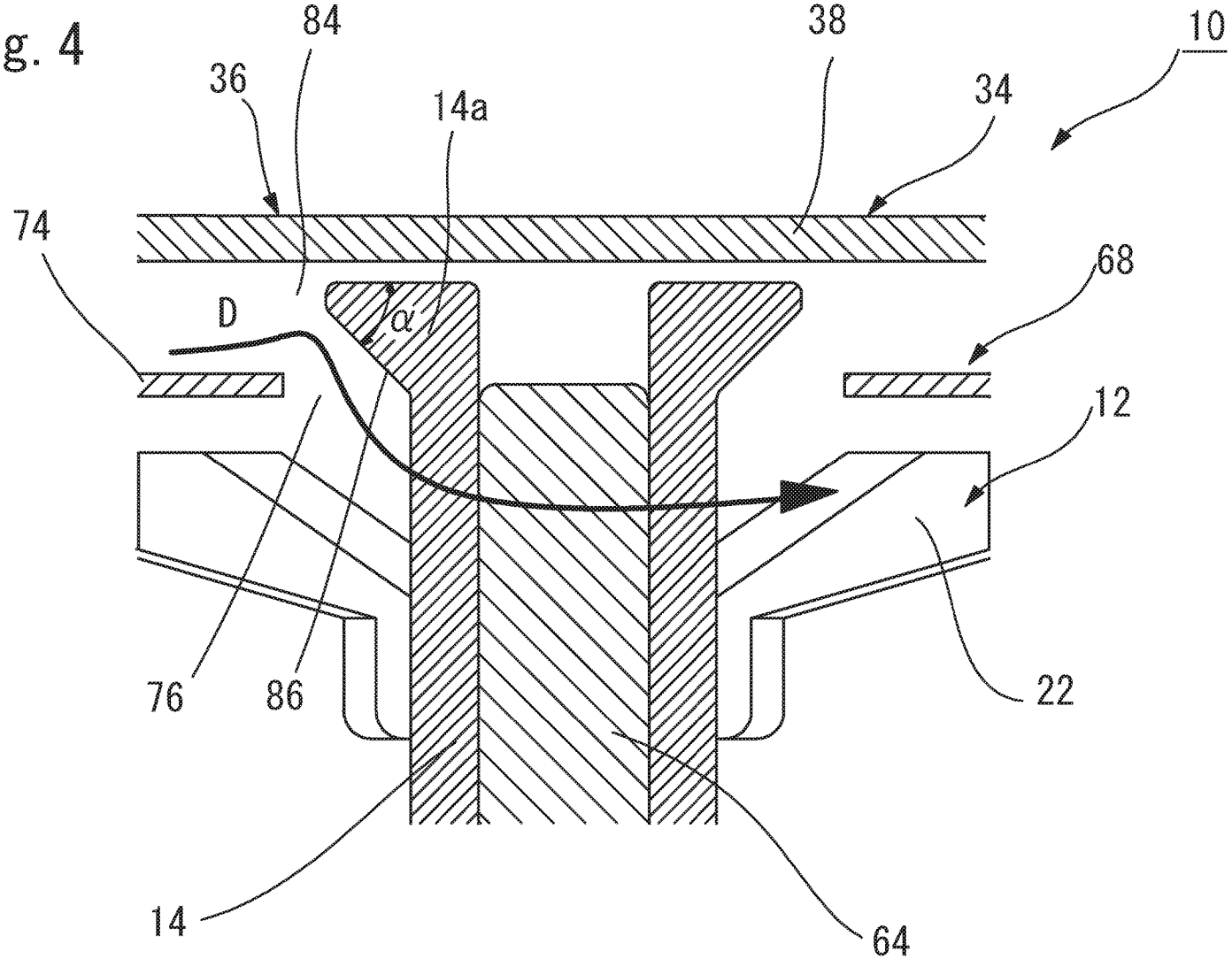
FIG. 4 is a partially enlarged cross sectional view similar to FIG. 2, in which Embodiment 2 of the centrifugal pump is shown.

FIG. 4 is a partially enlarged cross sectional view similar to FIG. 2 in which Embodiment 2 of the centrifugal pump is shown.

The centrifugal pump 10 of this Embodiment includes basically similar composition of the Embodiment 1 shown in FIG. 1-FIG. 3.

The same reference numerals refer to the same composition members, and the detailed explanation is omitted.

In the centrifugal pump 10 of this Embodiment, as shown in FIG. 4, an end of the bearing portion 14 of the impeller member 16 at an axial fluid introducing passage 84 side, that is, a top portion 14*a* of the bearing portion 14, a taper guide face 86, which is inclined from the outside diameter side to the inside diameter side, is formed.

In addition, this taper guide face 86, may be formed around the circumference of the top portion 14*a* of the bearing portion 14, or it may be also partially formed.

According to this taper guide face 86, as shown by arrow D of FIG. 4, the fluid introduced from the fluid introducing passage 84 can be smoothly guided and introduced from the inner periphery opening portion 76 of the blade casing 68 to the rotating accommodating space (the interior space S1 and the rotating accommodating space S2) that accommodates the rotating blade member 12.

Therefore, the pressure loss is not caused in the fluid flow and the pumping efficiency is not decreased.

Moreover, the noise such as an abnormal sound is not generated, and the durability and quietness are superior.

In this case, as shown in FIG. 4, it is desirable that, if such a guide effect is considered, the angle of gradient $\alpha$ of the taper guide face 86 is 10-80° and preferably 45°.

Embodiment 3

Figure 5:
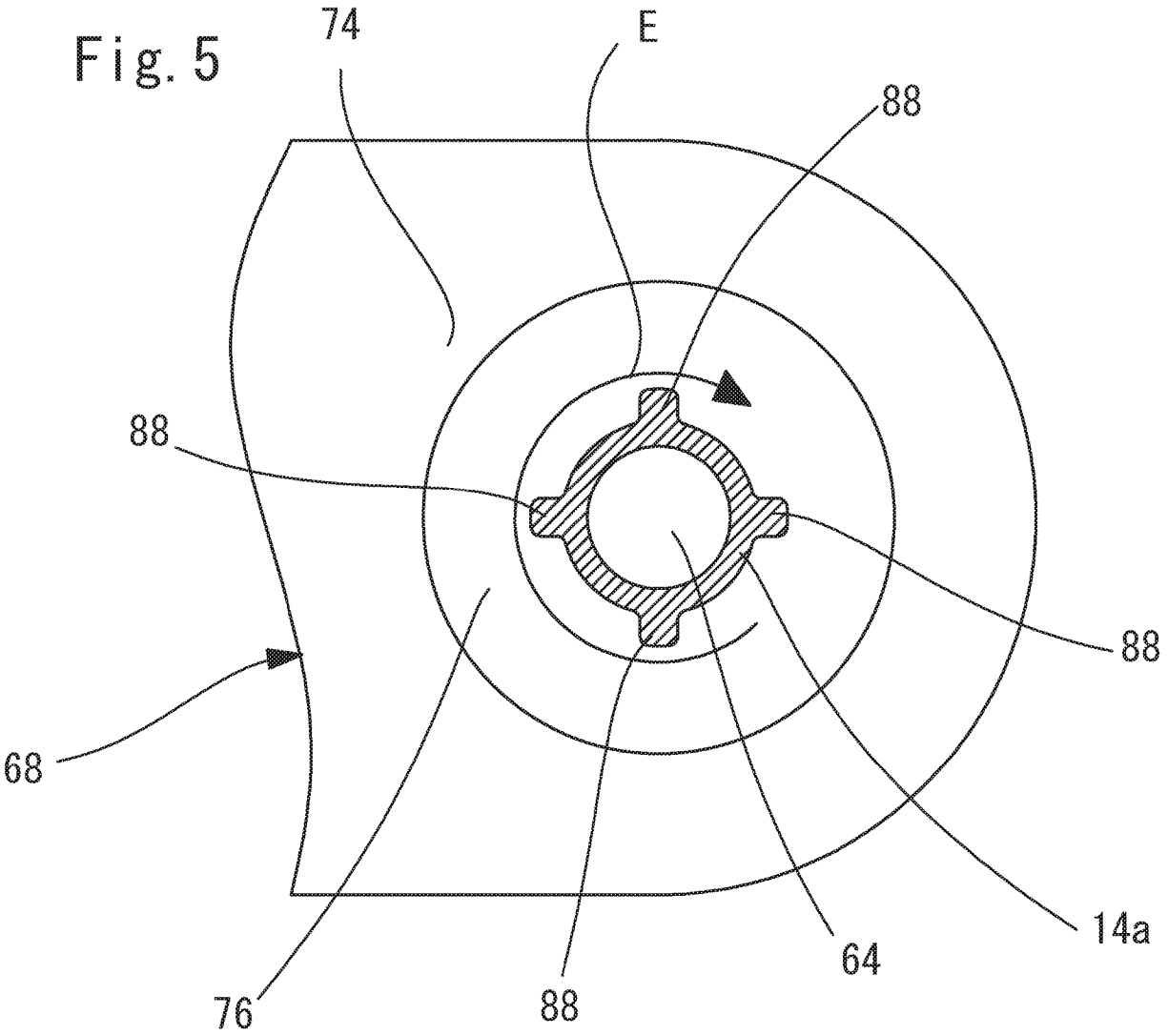
FIG. 5 is a partially enlarged cross sectional view similar to FIG. 3, in which Embodiment 3 of the centrifugal pump is shown.

FIG. 5 is a partially enlarged cross sectional view similar to FIG. 3 in which Embodiment 3 of the centrifugal pump is shown.

The centrifugal pump 10 of this Embodiment includes basically similar composition of the Embodiment shown in FIG. 1-FIG. 3.

The same reference numerals refer to the same composition members, and the detailed explanation is omitted.

In the centrifugal pump 10 of this Embodiment, as shown in FIG. 5, on the outer periphery of an end portion of the bearing portion 14 of the impeller member 16 at the axial fluid introducing passage 84 side, that is, the top portion 14*a* of the bearing portion 14, a protruding portion 88, which is protruded in the direction of the outside diameter, is formed.

In this case, in this Embodiment, as spaced by the predetermined space in the rotating direction (i.e. spaced by the central angle degree 90°), four protruding portions 88, which are protruded in the direction of the outside diameter, are formed.

By the configuration like this, the end portion of the bearing portion 14 of the impeller member 16 at the axial fluid introducing passage 84 side, that is, the top portion 14*a* of the bearing portion 14, is rotated together with this protruding portion 88.

As a result, when fluid passes from the fluid introducing passage 84 through the inner periphery opening portion 76 of the blade casing 68 and is introduced into the rotating accommodating space (the interior space S1 and the rotating accommodating space S2), as shown by arrow E of FIG. 5, a rotational flow is generated by the rotation of this protruding portion 88.

As a result, fluid can be more smoothly introduced into the rotating accommodating space.

In this case, in this Embodiment, as spaced by the predetermined space in the rotating direction, four protruding portions 88, which are protruded in the direction of the outside diameter, are formed.

However, the number of the protruding portions 88 may be one or more, and is not limited particularly.

Embodiment 4

Figure 6:
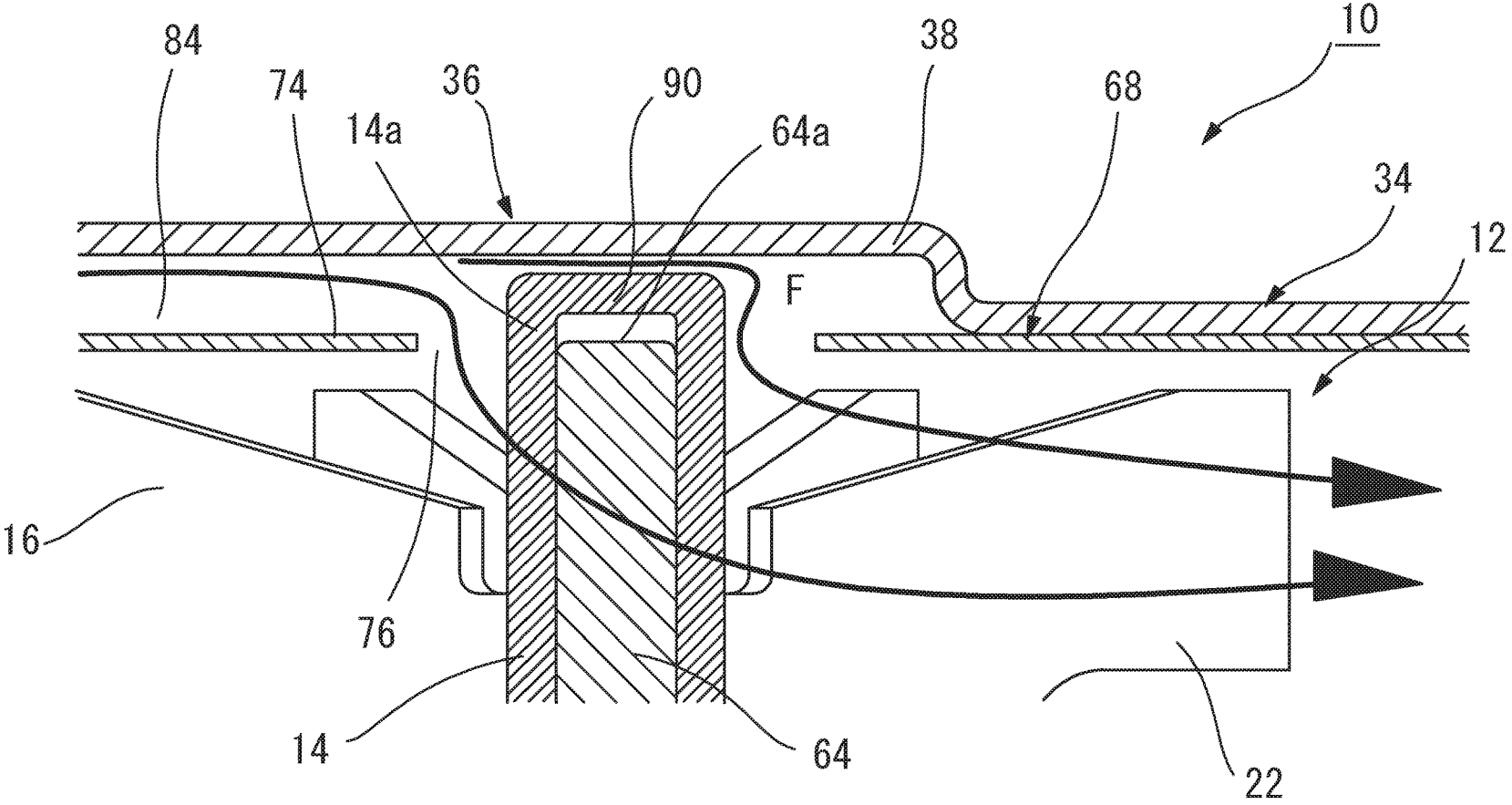
FIG. 6 is a partially enlarged cross sectional view similar to FIG. 2, in which Embodiment 4 of the centrifugal pump is shown.

FIG. 6 is a partially enlarged cross sectional view similar to FIG. 2 in which Embodiment 4 of the centrifugal pump is shown.

The centrifugal pump 10 of this Embodiment includes basically similar composition of the Embodiment 1 shown in FIG. 1-FIG. 3.

The same reference numerals refer to the same composition members, and the detailed explanation is omitted.

In the centrifugal pump 10 of this Embodiment, as shown in FIG. 6, an end portion of the bearing portion 14 of the impeller member 16 at the axial fluid introducing passage 84 side, that is, the top portion 14*a* of the bearing portion 14, is formed such that a coating portion 90, which covers a top portion 64*a* of the axial member 64, is provided.

By the configuration like this, by the coating portion 90 of the top portion 14*a* of the bearing portion 14, the top portion 64*a* of the axial member 64 is not exposed.

As a result, when fluid passes from the fluid introducing passage 84 through the inner periphery opening portion 76 of the blade casing 68 and is introduced into the rotating accommodating space (the interior space S1 and the rotating accommodating space S2), as shown by arrow F of FIG. 6, in addition to the rotation of the coating portion 90, at which this axial member 64 is not exposed, fluid can be more smoothly introduced into the rotating accommodating space.

Moreover, the top portion 64*a* of the axial member 64 is covered by the coating portion 90 of the top portion 14*a* of the bearing portion 14.

As a result, the resistance of the fluid can be reduced, the pressure loss is not caused in the fluid flow, and the pumping efficiency is not decreased.

Moreover, the end portion of the bearing portion 14 of the impeller member 16 at the axial fluid introducing passage 84 side, that is, the top portion 14*a* of the bearing portion 14, is formed such that a coating portion 90, which covers a top portion 64*a* of the axial member 64, is provided.

As a result, the foreign matter in the fluid is not invaded into the clearance between the axial member 64 and the bearing portion 14 of the impeller member 16, the impeller member 16 is rotated smoothly, and the pumping efficiency is not decreased.

Though not shown in the drawings, also in the centrifugal pump 10 of this Embodiment, as shown in Embodiment 2 of FIG. 4, the taper guide face 86 can be formed, and as shown in Embodiment 3 of FIG. 5, the protruding portion 88, which is protruded in the direction of the outside diameter, can be formed.

Embodiment 5

Figure 7:
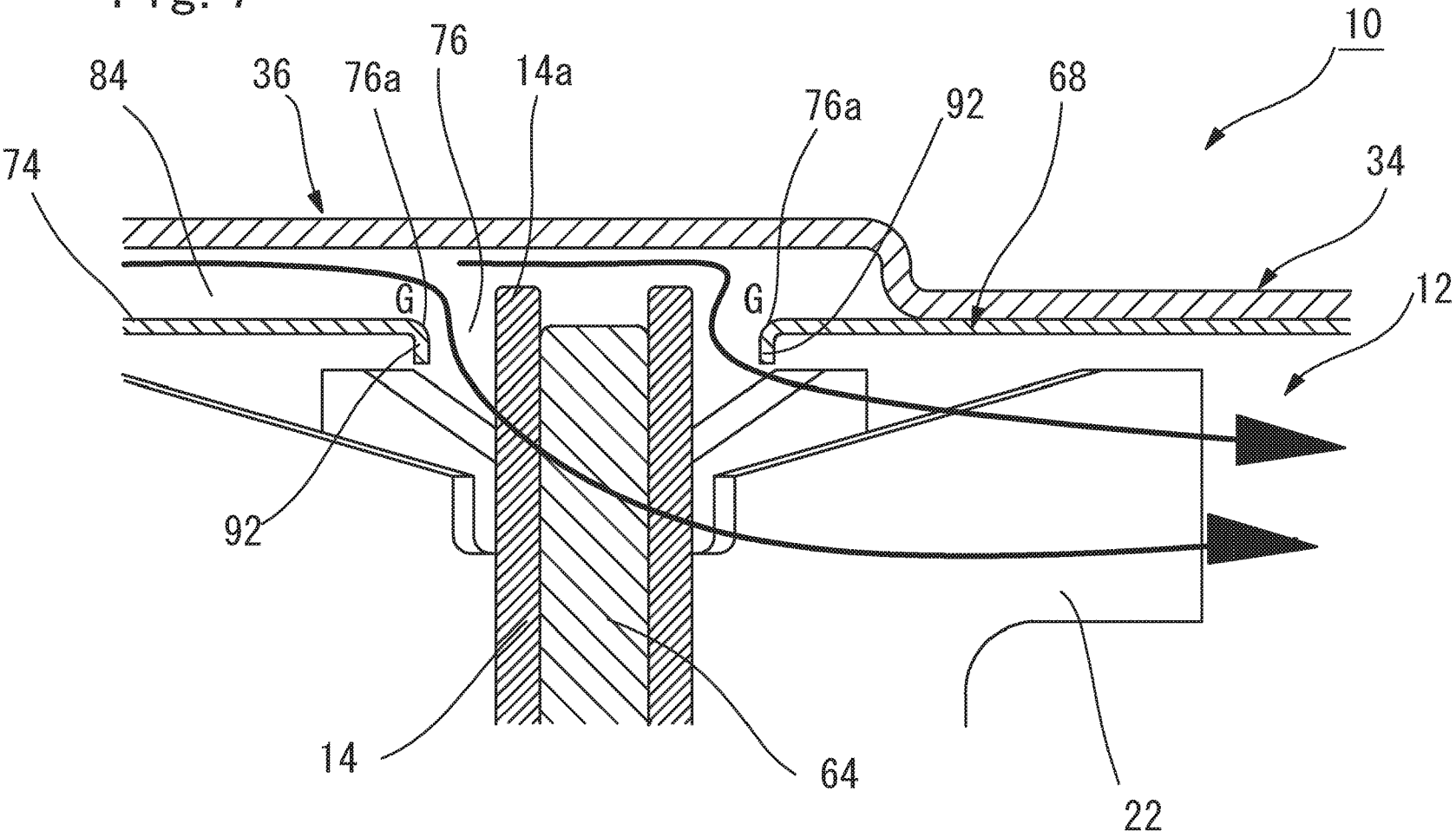
FIG. 7 is a partially enlarged cross sectional view similar to FIG. 2, in which Embodiment 5 of the centrifugal pump is shown.

FIG. 7 is a partially enlarged cross sectional view similar to FIG. 2 in which Embodiment 5 of the centrifugal pump is shown.

The centrifugal pump 10 of this Embodiment includes basically similar composition of the Embodiment 1 shown in FIG. 1-FIG. 3.

The same reference numerals refer to the same composition members, and the detailed explanation is omitted.

In the centrifugal pump 10 of this Embodiment, as shown in FIG. 7, on an opening edge 76*a* of the inner periphery opening portion 76 of the blade casing 68, a guide protruding portion 92 which is protruded to the rotating accommodating space (the interior space S1 and the rotating accommodating space S2).

In addition, as for this guide protruding portion 92, it may be formed around circumference of the opening edge 76*a* of the inner periphery opening portion 76 of the blade casing 68.

However, it may be formed on the opening edge 76*a* of the inner periphery opening portion 76.

As a result, as shown by arrow G of FIG. 7, the fluid introduced from the fluid introducing passage 84 can be smoothly guided and introduced from the inner periphery opening portion 76 of the blade casing 68 to the rotating accommodating space (the interior space S1 and the rotating accommodating space S2) that accommodates the rotating blade member 12.

Moreover, by rotation of the guide protruding portion 92 which is protruded to the rotating accommodating space (the interior space S1 and the rotating accommodating space S2) side, the fluid introduced from the fluid introducing passage 84 can be smoothly introduced into the rotating accommodating space that accommodates the rotating blade member 12.

As a result, the resistance of the fluid can be reduced, the pressure loss is not caused in the fluid flow, and the pumping efficiency is not decreased.

Though not shown in the drawings, also in the centrifugal pump 10 of this Embodiment, as shown in Embodiment 2 of FIG. 4, the taper guide face 86 can be formed, and as shown in Embodiment 3 of FIG. 5, the protruding portion 88, which is protruded in the direction of the outside diameter, can be formed.

In addition, as shown in Embodiment 4 of FIG. 6, the coating portion 90 can be formed.

Embodiment 6

Figure 8:
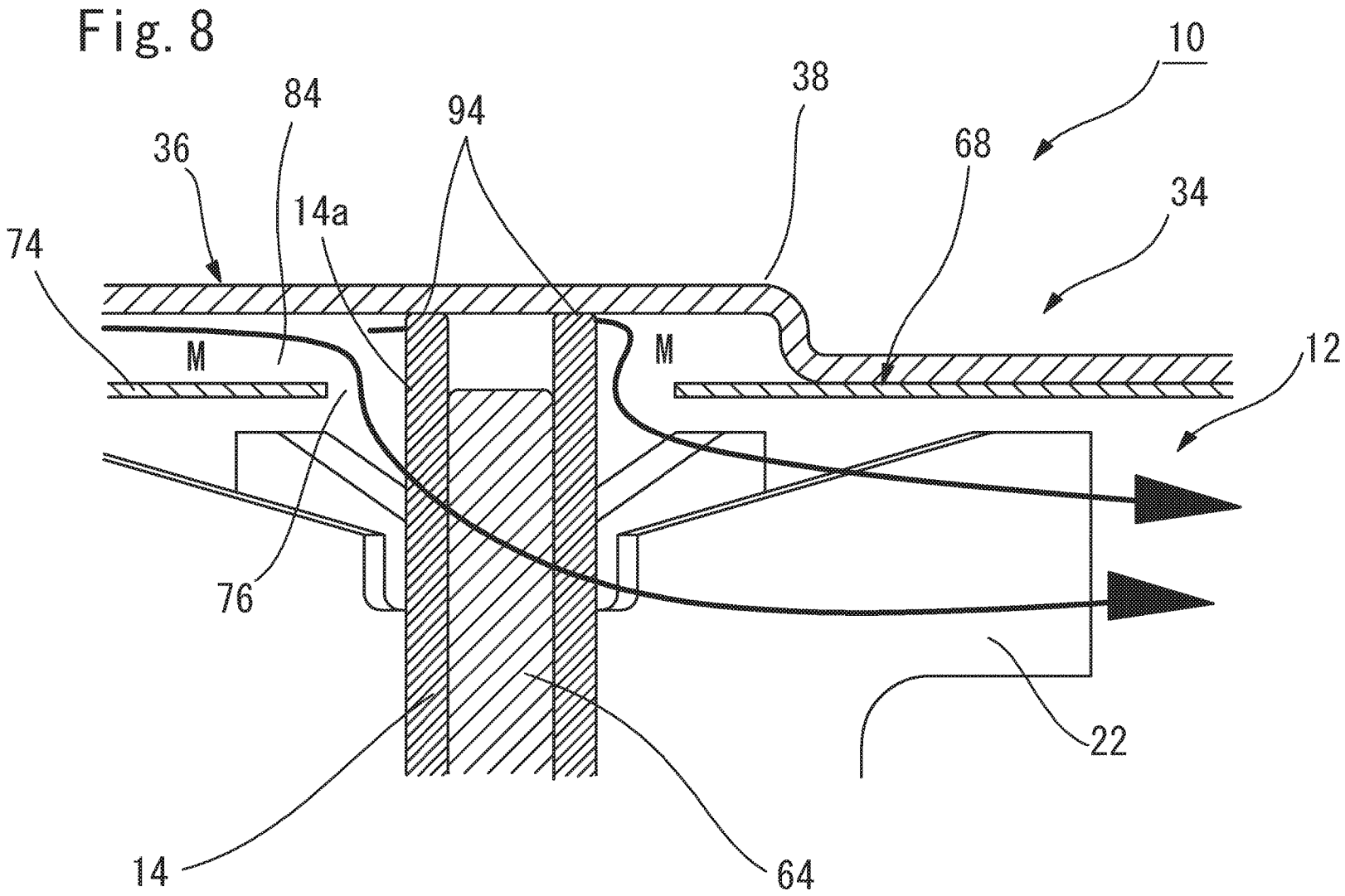
FIG. 8 is a partially enlarged cross sectional view similar to FIG. 2, in which Embodiment 6 of the centrifugal pump is shown.

FIG. 8 is a partially enlarged cross sectional view similar to FIG. 2 in which Embodiment 6 of the centrifugal pump is shown.

The centrifugal pump 10 of this Embodiment includes basically similar composition of the Embodiment 1 shown in FIG. 1-FIG. 3.

The same reference numerals refer to the same composition members, and the detailed explanation is omitted.

In the centrifugal pump 10 of this Embodiment, as shown in FIG. 8, an end portion of the bearing portion 14 of the impeller member 16 at the axial fluid introducing passage 84 side, that is, the top portion 14*a* of the bearing portion 14, is extended such that it touches the main body casing 34 and forms a rotation sliding portion 94.

As a result, the end portion of the bearing portion 14 of the impeller member 16 at the axial fluid introducing passage side 84, that is, the top portion 14*a* of the bearing portion 14, is supported by the rotation sliding portion 94.

Consequently, the axial member 64 is not inclined (does not swing), and as shown by arrow M of FIG. 8, the above-mentioned rotational flow (rectification) is surely generated.

Therefore, the fluid introduced from the fluid introducing passage 84 can be smoothly guided and introduced from the inner periphery opening portion 76 of the blade casing 68 to the rotating accommodating space (the interior space S1 and the rotating accommodating space S2) that accommodates the rotating blade member 12.

As a result, the resistance of the fluid can be reduced, the pressure loss is not caused in the fluid flow, and the pumping efficiency is not decreased.

Though not shown in the drawings, also in the centrifugal pump 10 of this Embodiment, as shown in Embodiment 2 of FIG. 4, the taper guide face 86 can be formed, and as shown in Embodiment 3 of FIG. 5, the protruding portion 88, which is protruded in the direction of the outside diameter, can be formed.

In addition, as shown in Embodiment 4 of FIG. 6, the coating portion 90 can be formed, and as shown in Embodiment 5 of FIG. 7, the guide protruding portion 92 can be formed.

Embodiment 7

Figure 9:
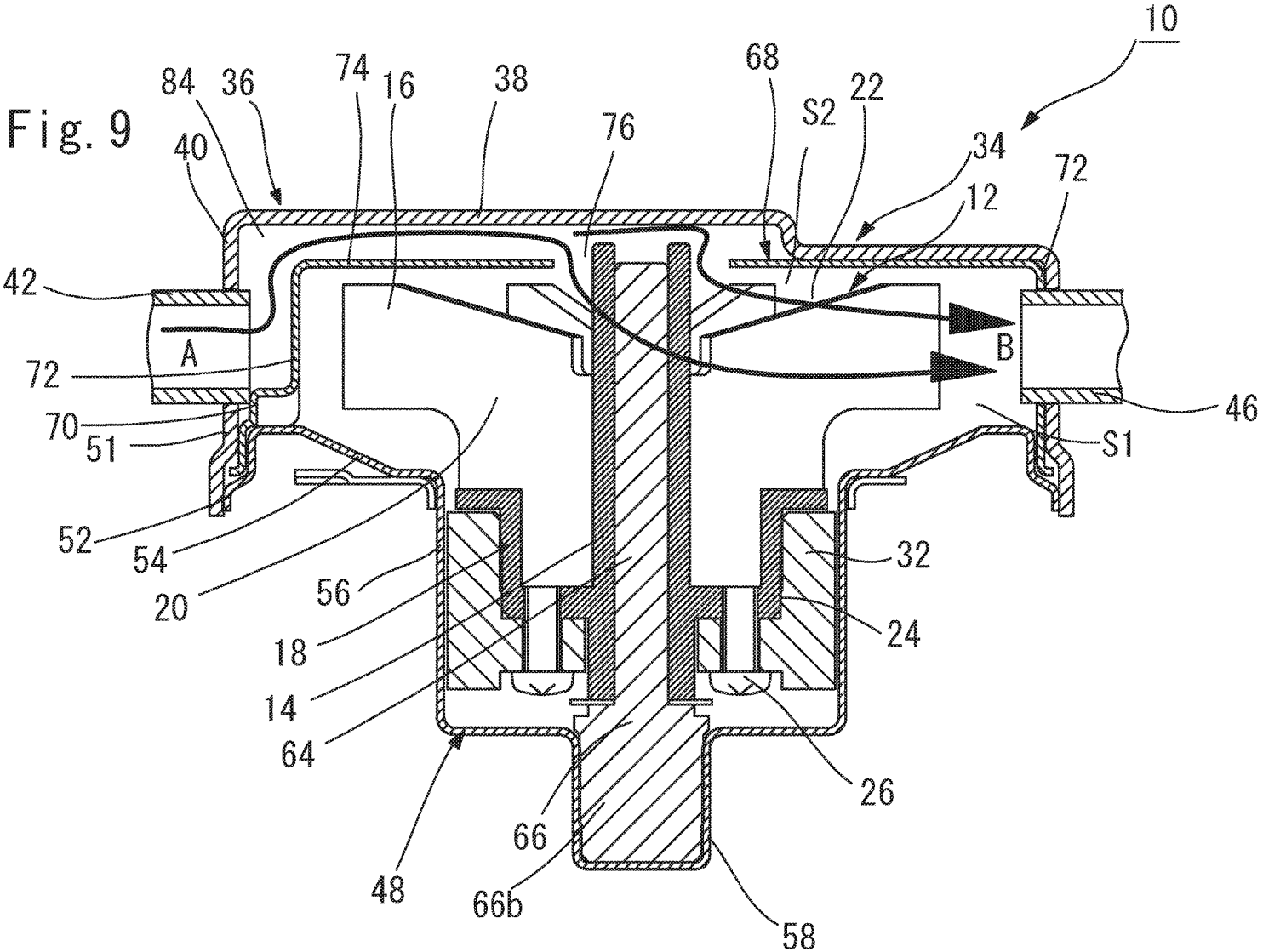
FIG. 9 is a vertical cross sectional view similar to FIG. 1, in which Embodiment 7 of the centrifugal pump is shown.

FIG. 9 is a vertical cross sectional view similar to FIG. 1 in which Embodiment 7 of the centrifugal pump is shown.

The centrifugal pump 10 of this Embodiment includes basically similar composition of the Embodiment 1 shown in FIG. 1-FIG. 3.

The same reference numerals refer to the same composition members, and the detailed explanation is omitted.

In the centrifugal pump 10 of Embodiment 1 shown in FIG. 1-FIG. 3, in the lower bearing member accommodating portion 58 of the lower main body casing 48, the lower bearing member 60 is fitted by, for instance, press fit etc.

In the shaft hole 62 formed in this lower bearing member 60, the lower end portion 66 of the axial member 64 is fixed as pivoted by, for instance, press fit etc.

On the contrary, in the centrifugal pump 10 of this Embodiment, as shown in FIG. 9, the axial member 64 is fixed directly, by an enlarged diameter portion 66*b* of the lower end portion 66 of the axial member 64, to an end portion of the main body casing at the axial rotor magnet 32 side in the axial direction of the axial member 64, that is, to the lower bearing member accommodating portion 58 of the lower main body casing 48.

As a result, the axial member 64 is not inclined (does not swing), the above-mentioned rotational flow (rectification) is surely generated.

As a result, the fluid introduced from the fluid introducing passage 84 can be smoothly guided and introduced from the inner periphery opening portion 76 of the blade casing 68 to the rotating accommodating space (the interior space S1 and the rotating accommodating space S2) that accommodates the rotating blade member 12.

As a result, the resistance of the fluid can be reduced, the pressure loss is not caused in the fluid flow, and the pumping efficiency is not decreased.

Moreover, in the centrifugal pump 10 of this Embodiment, since the lower bearing member 60 can be omitted, the number of parts can be decreased, assembly is easy, and the cost can be reduced.

Though not shown in the drawings, also in the centrifugal pump 10 of this Embodiment, as shown in Embodiment 2 of FIG. 4, the taper guide face 86 can be formed, and as shown in Embodiment 3 of FIG. 5, the protruding portion 88, which is protruded in the direction of the outside diameter, can be formed.

In addition, as shown in Embodiment 4 of FIG. 6, the coating portion 90 can be formed, and as shown in Embodiment 5 of FIG. 7, the guide protruding portion 92 can be formed.

Furthermore, as shown in Embodiment 6 of FIG. 8, the rotation sliding portion 94 can be formed.

Although preferable embodiments are described above, the embodiments are not limited to these embodiments.

For instance, in the above-mentioned Embodiment, materials of the main body casing 34, the upper main body casing 36, the lower main body casing 48, and the blade casing 68, etc. may be made of metallic, or may be made of plastic, and it may be selected appropriately according to the usage, and it is not limited particularly.

In addition, in the Embodiment, the number of the suction side coupling member 42 and the discharge side coupling member 46 is assumed to be one piece respectively.

However, the number of suction side coupling members 42 and discharge side coupling members 46 can be plurality.

Therefore, various changes are possible in the scope.

INDUSTRIAL APPLICABILITY

Embodiments can be applied to a centrifugal pump and a method of producing of the centrifugal pump to circulate the fluid in the closed circuit, for instance, refrigerant used for refrigerant circulation circuits such as air conditioners and freezers, and cooling water etc. used for cooling circulation circuits for parts, apparatuses that generate heat, etc.

EXPLANATION OF LETTERS OR NUMERALS

10
Centrifugal pump
12
Rotating blade member
14
Bearing portion
**14*a***
Top portion
**14*b***
End
16
Impeller member
18
Base end portion
20
Enlarged diameter portion
22
Outside blade portion
**22*a***
End
24
Rotor magnet accommodating portion
26
Screw member
32
Rotor magnet
34
Main body casing
36
Upper main body casing
38
Top wall
40
Side peripheral wall
42
Suction side coupling member
46
Discharge side coupling member
48
Lower main body casing
51
Lower end part
52
Outer periphery flange
54
Blade accommodating portion
56
Rotor magnet accommodating portion
58
Lower bearing member accommodating portion
60
Lower bearing member
62
Shaft hole
64
Axial member
**64*a***
Top portion
66
Lower end portion
**66*b***
Enlarged diameter portion
68
Blade casing
70
Outer periphery flange
72
Side peripheral wall
74
Extending portion
76
Inner periphery opening portion
**76*a***
Opening edge
84
Fluid introducing passage
86
Taper guide face
88
Protruding portion
90
Coating portion
92
Guide protruding portion
94
Rotation sliding portion
100
Centrifugal pump
102
Rotating blade member
104
Bearing portion
106
Impeller member
108
Base end portion
110
Enlarged diameter portion
112
Outside blade portion
122
Rotor magnet
124
Main body casing
126
Upper main body casing

128
Top wall
**128*a***
Protruding portion
130
Side peripheral wall
132
Suction side coupling member
136
Discharge side coupling member
138
Lower main body casing
141
Lower end part
142
Outer periphery flange
144
Blade accommodating portion
146
Rotor magnet accommodating portion
148
Lower bearing member accommodating portion
150
Lower bearing member
152
Shaft hole
154
Axial member
156
Lower end portion
158
Blade casing
160
Outer periphery flange
161
Fixing holder
162
Side peripheral wall
164
Extending portion
**164*a***
Inner periphery opening portion
168
Upper bearing member
170
Shaft hole
172
Top portion
174
Fluid introducing passage
186
Main body casing side fixing bracket
204
Coil portion
206
Bobbin casing
208
Winding wire
210
Coil
214
Coil cover main body
216
Coil side fixing protruded portion
226
Connector
228
Lead line
230
Magnetic pole sensor
240
Screw member
300
Circulation type pump
302
Bearing
304
Cover
306
Bearing holding portion
308
Thrust pad member
310
Inclination surface
312
Pump station
314
Introducing passage
H1
Distance
H2
Distance
R
Outside diameter
S1
Interior space
S2
Rotating accommodating space
$\alpha$
Angle of gradient

What is claimed:

1. A centrifugal pump comprising:

a rotating blade member including an impeller member and a rotor magnet associated with the impeller member;

a main body casing in which the rotating blade member is accommodated;

a coil portion that rotates the rotating blade member, wherein the coil portion is located on a periphery of the rotor magnet;

an axial member which is associated with the main body casing, wherein the rotating blade member pivots around the axial member; and a bearing portion associated with the impeller member, wherein the axial member is disposed in the bearing portion and is supported by the bearing portion, wherein the axial member includes a first end portion and a second end portion in an axial direction of the axial member, the first end portion is disposed at a rotor magnet side in the main body casing, and the axial member is fixed at the first end portion, the second end portion of the axial member is not fixed in the main body casing, the main body casing forms a fluid introducing passage, and is associated with a blade casing in which the rotating blade member is accommodated, the bearing portion associated with the impeller member has a third end portion in an axial direction of the bearing portion, and the third end portion protrudes from an inner periphery opening portion of the blade casing into the fluid introducing passage.

2. The centrifugal pump of claim 1, wherein the bearing portion associated with the impeller member is rotated together with the impeller member.

3. The centrifugal pump of claim 1, wherein the bearing portion associated with the impeller member is integrally formed with the impeller member.

4. The centrifugal pump of claim 1, wherein the third end portion has a taper guide surface, wherein the taper guide surface guides, from the inner periphery opening portion of the blade casing to a rotating accommodating space that accommodates the rotating blade member, the fluid introduced from the fluid introducing passage, and the taper guide surface is inclined from a point in the fluid introducing passage along the axial direction of the bearing portion.

5. The centrifugal pump of claim 1, wherein a protruding portion protrudes, in a direction of an outer diameter of the bearing portion, from at an outer periphery of the third end portion.

6. The centrifugal pump of claim 1, wherein the third end portion of the bearing portion covers the axial member.

7. The centrifugal pump of claim 1, wherein a guide protruding portion is formed at a periphery of an inner periphery opening portion of the blade casing, and wherein the guide protruding portion protrudes toward a rotating accommodating space, and guides, from the inner periphery opening portion of the blade casing to a rotating accommodating space in which the rotating blade member is accommodated, the fluid introduced from the fluid introducing passage.

8. The centrifugal pump of claim 1, wherein the third end portion is extended such that the third end portion touches the main body casing and forms a rotation sliding portion.

9. The centrifugal pump of claim 1, wherein the axial member is fixed directly at the first end portion of the axial member in an axial direction of the axial member in the main body casing.

10. The centrifugal pump of claim 1, wherein the third end portion has an end which faces the main body casing, and an axial distance between the said end of the third end portion and the main body casing is H1, a blade portion of the impeller member has an end which faces the blade casing, an axial distance between said end of the blade portion and the blade casing is H2, and H1 is smaller than H2.

* * * * *